US006948329B2

(12) United States Patent
Nomura et al.

(10) Patent No.: US 6,948,329 B2
(45) Date of Patent: Sep. 27, 2005

(54) AUGER TYPE ICE MACHINE

(75) Inventors: Tomohito Nomura, Aichi (JP); Hideo Sumikawa, Aichi (JP)

(73) Assignee: Hoshizaki Denki Kabushiki Kaisha, Toyoake (JP)

( * ) Notice: Subject to any disclaimer, the term of this patent is extended or adjusted under 35 U.S.C. 154(b) by 0 days.

(21) Appl. No.: 10/489,329

(22) PCT Filed: Sep. 11, 2002

(86) PCT No.: PCT/JP02/09285

§ 371 (c)(1),
(2), (4) Date: Mar. 11, 2004

(87) PCT Pub. No.: WO03/025478

PCT Pub. Date: Mar. 27, 2003

(65) Prior Publication Data

US 2004/0194481 A1 Oct. 7, 2004

(30) Foreign Application Priority Data

Sep. 13, 2001 (JP) ..... 2001-277802
Feb. 6, 2002 (JP) ..... 2002-029681

(51) Int. Cl.[7] ..... F25C 1/14
(52) U.S. Cl. ..... 62/354
(58) Field of Search ..... 62/136, 354

(56) References Cited

U.S. PATENT DOCUMENTS 3,449,920 A * 6/1969 Steenburgh, Jr. ..... 62/136
3,650,121 A * 3/1972 Kimpel et al. ..... 62/136
5,086,261 A * 2/1992 Sakata et al. ..... 318/268
5,440,892 A * 8/1995 Tatematsu et al. ..... 62/135
6,356,710 B1 * 3/2002 Sato et al. ..... 388/804

FOREIGN PATENT DOCUMENTS

JP 64-005724 2/1989
JP 02-213669 8/1990
JP 10-185382 7/1998

* cited by examiner

*Primary Examiner*—William E. Tapolcai
(74) *Attorney, Agent, or Firm*—Wenderoth, Lind & Ponack, L.L.P.

(57) ABSTRACT

An auger type ice machine in which the load on a geared motor and an upper bearing is mitigated by detecting the load on an auger. A geared motor (9) disposed below a cylinder (1). A rotor (12) of the geared motor has an output shaft (13). A pulse encoder (14) is provided on the output shaft (13). The geared motor (9) is connected with a geared motor power supply (16) through a relay (15). Similarly, a compressor (3) is connected with a compressor power supply (18) through a relay (17). The relays (15) and (17) are controlled by a control portion (19). The control portion (19) controls the relays (15) and (17) according to a signal inputted from the pulse encoder (14).

8 Claims, 6 Drawing Sheets

AUGER TYPE ICE MACHINE

BACKGROUND OF THE INVENTION

1. Field of the Invention

The present invention relates to an auger type ice making machine.

2. Description of Related Art

Generally speaking, in an auger type ice making machine, an evaporation pipe for cooling is wound around the outer peripheral surface of a cylinder, and an auger is provided inside this cylinder so as to be coaxial with the longitudinal axis of the cylinder and rotatable. A helical blade is provided on the outer peripheral surface of the auger. Ice making water supplied into the cylinder adheres to the inner peripheral surface of the cylinder as ice. The ice thus adhering is scraped off by the helical blade of the auger rotated by a gear motor, and is brought upwards to the upper portion of the cylinder by a screw feed action. The ice thus brought upwards is compressed in a compression passage provided above the cylinder, and cut by a cutter into ice chips.

However, in the auger type ice making machine described above, when ice clogging in the compression passage or a shortage of ice making water supply occurs, the cylinder may be cooled excessively. If, in such a case, the operation of the ice making machine is continued, there is a possibility of all the ice making water in the cylinder being frozen. Rotating the auger in the state in which all the ice making water has been frozen causes an excessive load to be applied to the geared motor and the upper bearing of the auger, and it can lead to damage of the geared motor and the upper bearing.

SUMMARY OF THE INVENTION

The present invention has been made with a view toward solving the above problem in the prior art. It is an object of the present invention to provide an auger type ice making machine in which the load applied to the geared motor and the upper bearing is mitigated by detecting the load applied to the auger.

In order to attain the above-mentioned object, an auger type ice making machine equipped with a geared motor for driving an auger is characterized by including: an RPM detecting means for detecting the RPM of a rotor of the geared motor; and a control means for controlling a rotation of the geared motor based on the RPM detected by the RPM detecting means.

Further, the auger type ice making machine equipped with a geared motor for driving an auger and a compressor for compressing a refrigerant is characterized by including: an RPM detecting means for detecting the RPM of a rotor of the geared motor; and a control means for controlling the rotation of the compressor based on the RPM detected by the RPM detecting means.

Further, the auger type ice making machine is characterized in that the RPM detecting means is a pulse encoder or a rotary encoder.

Further, the auger type ice making machine is characterized in that the RPM detecting means is equipped with an RPM output portion operationally connected with the rotor and an RPM detecting portion adapted to detect RPM from an operation of the RPM output portion, and that the auger type ice making machine further includes an RPM detecting means cover formed by integrally molding a portion covering at least a part of the rotor and a portion covering the RPM output portion.

DETAILED DESCRIPTION OF THE INVENTION

Embodiments of the present invention will now be described with reference to the accompanying drawings.

Embodiment 1

Figure 1:
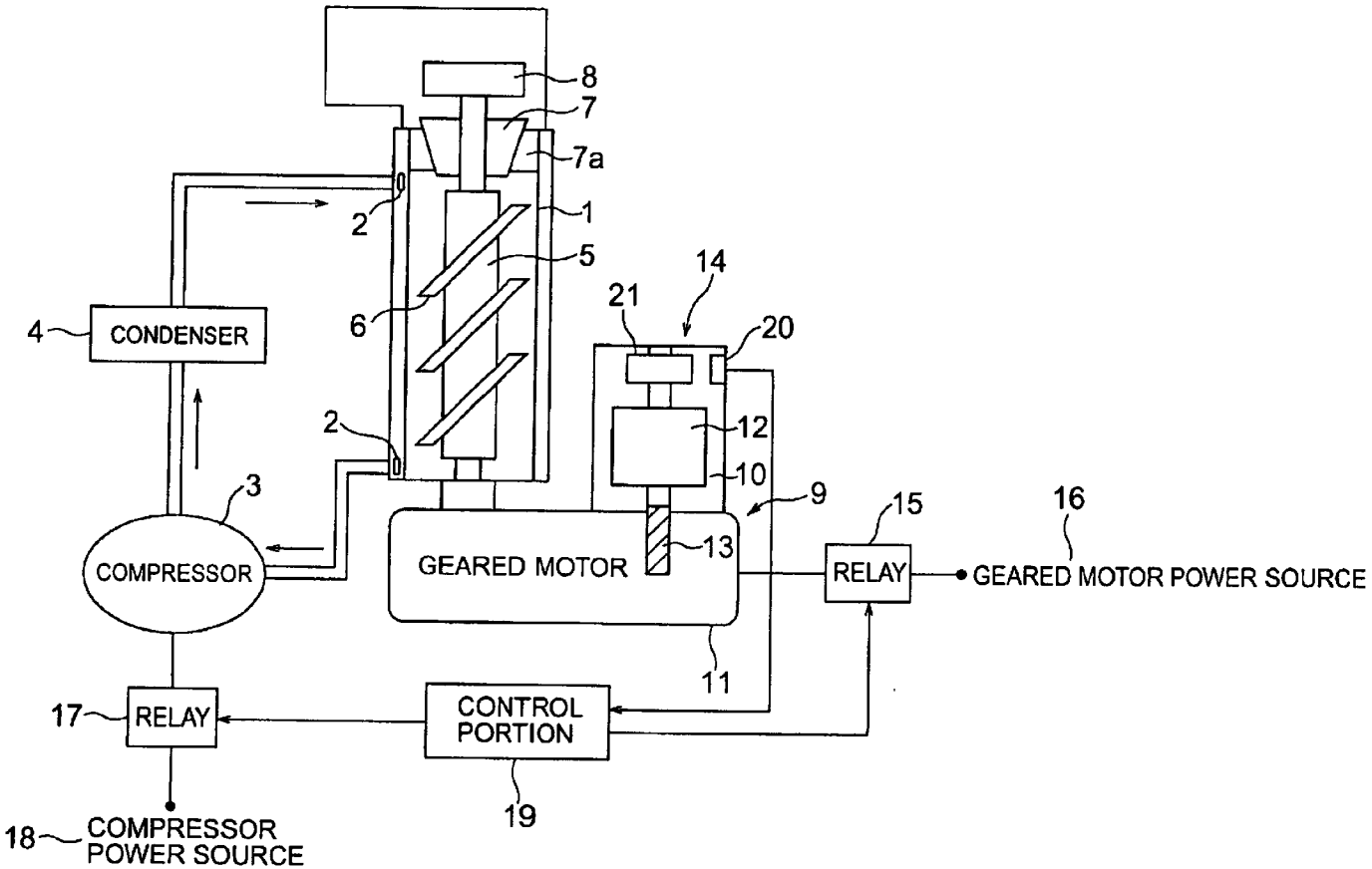
FIG. 1 is a diagram showing a construction of an auger type ice making machine according to Embodiment 1 of the present invention.

FIG. 1 shows the construction of an auger type ice making machine according to the first embodiment of the present invention. An evaporation pipe 2 is wound around the outer peripheral surface of a cylinder 1. The evaporation pipe 2 is connected to a compressor 2 and a condenser 4 and constitutes a refrigeration circuit. Inside the cylinder 1, there is provided an auger 5 which is coaxial with the longitudinal axis of the cylinder 1 and which is rotatable. A helical blade 6 is provided on the outer peripheral surface of the auger 5. Above the cylinder 1, there is provided a pressure head 7 having a compression passage 7*a*. A cutter 8 is provided above the pressure head 7. Below the cylinder 1, there is provided a geared motor 9. The geared motor 9 is equipped with a motor portion 10 and a speed reduction portion 11. The lower end of the auger 5 is connected to the motor portion 10 through the speed reduction portion 11. The motor portion 10 has a rotor 12. The rotor 12 is equipped with an output shaft 13. The output shaft 13 is equipped with a pulse encoder 14 described below serving as an RPM detecting means for the rotor 12. The geared motor 9 is connected to a geared motor power source 16 through a relay 15. Similarly, the compressor 3 is connected to a compressor power source 18 through a relay 17. The relays 15 and 17 are controlled by a control portion 19 serving as a control means. The control portion 19 controls the relays 15 and 17 based on signals input from the pulse encoder 14.

Figure 2:
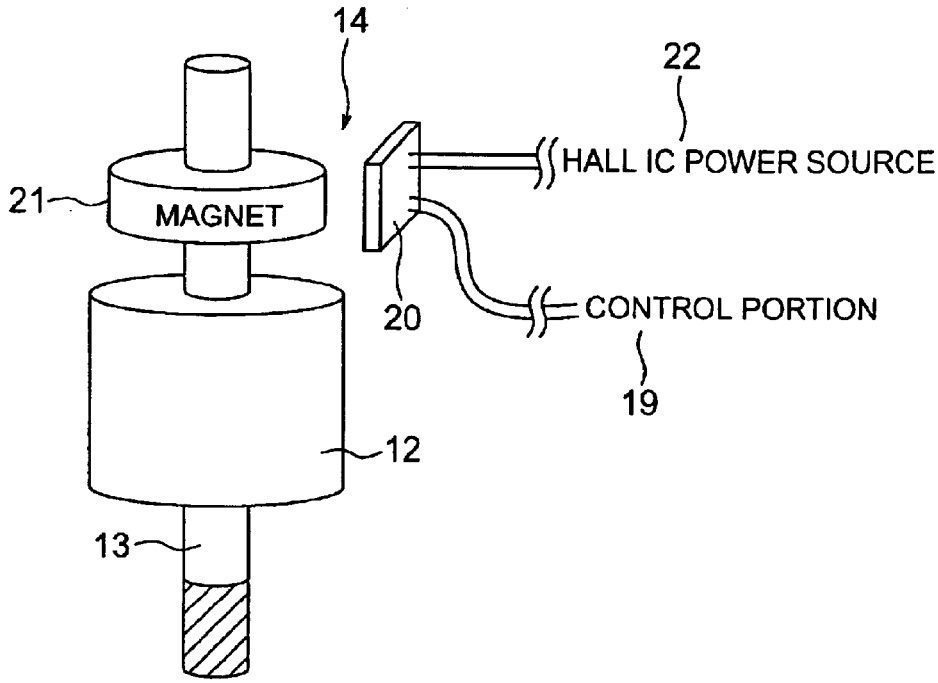
FIG. 2 is a diagram schematically showing a pulse encoder in the auger type ice making machine of Embodiment 1.
Figure 3:
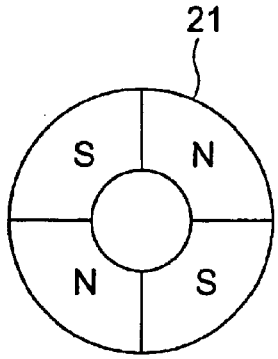
FIG. 3 is a plan view showing a part of the pulse encoder of FIG. 2.

The pulse encoder 14 will be described with reference to FIGS. 2 and 3. The pulse encoder 14 is equipped with a Hall IC 20 and a rotary magnet 21. The Hall IC 20 is secured at a position opposed to the rotary magnet 21. The Hall IC 20 is connected to a Hall IC power source 22 and the control portion 19. The rotary magnet 21 is provided on the output shaft 13, which is adapted to rotate integrally with the rotor 12, and rotates integrally with the output shaft 13. FIG. 3 is a plan view of the rotary magnet. The rotary magnet 21 shown in FIG. 3 is a four-pole magnet. It is to be noted, however, that the rotary magnet is not restricted to a four-pole one.

The Hall IC 20 has a magnetic sensor portion. The magnetic sensor portion senses the magnetism of the rotary magnet 2l to thereby detect the RPM of the output shaft 13. For example, when a four-pole rotary magnet is used, the pole opposed to the Hall IC 20, for example, an N-pole is sensed by the magnetic sensor portion. Since the rotary magnet 21 rotates together with the output shaft 13, the pole of the rotary magnet 21 opposing the Hall IC 20 varies with rotation. Thus, after detecting an N-pole first, the magnetic sensor senses an S-pole next. Thereafter, it continues to alternately sense N-and S-poles. Since a four-pole rotary magnet is used, when the magnetic sensor has detected two N-poles and two S-poles, it means the output shaft 13 has made one rotation. The RPM of the output shaft 13 thus obtained is transmitted to the control portion 19.

Next, the operation of the auger ice making machine of the first embodiment will be described. The cylinder 1 is cooled by the evaporation pipe 2. As indicated by the arrows, the refrigerant cooling the evaporation pipe 2 flows from the evaporation pipe 2 to the compressor 3, from the compressor 3 to the condenser 4, and from the condenser 4 to the evaporation pipe 2, thus effecting circulation. Ice making water supplied into the cylinder 1 is cooled and adheres to the inner peripheral surface of the cylinder 1 as ice. The ice thus adhering is scraped off by the helical blade 6 of the auger 5 rotated by the geared motor 9. The ice pieces are brought upwards by the screw feed action of the helical blade 6 to the compression passage 7a above the cylinder 6. In the compression passage 7*a*, the ice pieces are compressed and cut by a cutter 8 into ice chips. In the geared motor 9, the rotation of the rotor 12 of the motor portion 10 is transmitted to the auger 5 through the output shaft 13 and the speed reduction portion 11 to thereby rotate the auger 5. The RPM of the rotor 12, that is, the RPM of the output shaft 13, is detected by the pulse encoder 14. The RPM detected as a signal is input to the control portion 19 from the pulse encoder 14. The control portion 19 controls the relays 15 and 17 on the basis of this signal. That is, when the RPM of the output shaft 13 detected by the pulse encoder 14 becomes smaller than the normal value, the control portion 19 controls the relays 15 and 17 to stop the geared motor 9 and the compressor 3. That is, the relay 15 causes a contact (not shown) between the geared motor 9 and the power source 16 to be opened, whereby the power supply to the geared motor 9 is cutoff. Similarly, the relay 17 causes a contact (not shown) between the compressor 3 and the power source 18 to be opened, whereby the power supply to the compressor 3 is cut off.

Generally speaking, when ice clogging in the compression passage or shortage in ice making water supply occurs, the cylinder is excessively cooled. Due to the excessive cooling of the cylinder, the growth of the ice adhering to the inner peripheral surface of the cylinder is promoted. As a result of the growth of the ice, the load on the rotation of the auger equipped with the helical blade for scraping off the ice increases. When the rotation load of the auger increases, load is applied to the rotor of the geared motor for rotating the auger, and the RPM of the rotor decreases. That is, a reduction in the RPM of the rotor indicates an increase in the load on the auger or excessive cooling of the interior of the cylinder. In view of this, the rotor 12 is equipped with the pulse encoder 14 to detect the RPM thereof. When the RPM of the output shaft 13 becomes equal to or smaller than a fixed value, that is, when the load on the auger 5 becomes equal to or larger than a fixed value, the control portion 19 cuts off the power sources of the geared motor 11 and of the compressor 3 to stop them. By stopping the geared motor 11, it is possible to prevent an excessive load from being applied to the geared motor 11. Normally, the geared motor is locked when an excessive load is applied thereto. When locked, the geared motor tries to continue rotation even after stopping, or continues to impart torque through hunting. Thus, when the geared motor is stopped upon a first reduction in RPM, it is possible to prevent such a load after locking. Further, since the geared motor is stopped before being locked, it is possible to eliminate or mitigate the load applied to the geared motor at the time of locking.

Further, by stopping the compressor 3, it is possible to stop the cooling of the cylinder 1, thereby preventing all the ice making water in the cylinder from being frozen by excessive cooling. Since the cooling is stopped before the interior of the cylinder 1 has frozen completely, that is, at the stage in which the ice is growing, recovery is more quickly effected than in the case in which complete freezing has occurred.

Further, since the pulse encoder 14 is directly mounted to the output shaft 13, and the fluctuations in load are directly read, a high level of reliability is achieved. Further, due to the pulse encoder 14, the load is indicated as a marked delay in RPM, so that it is possible to cope with any change more quickly.

Embodiment 2

Figure 4:
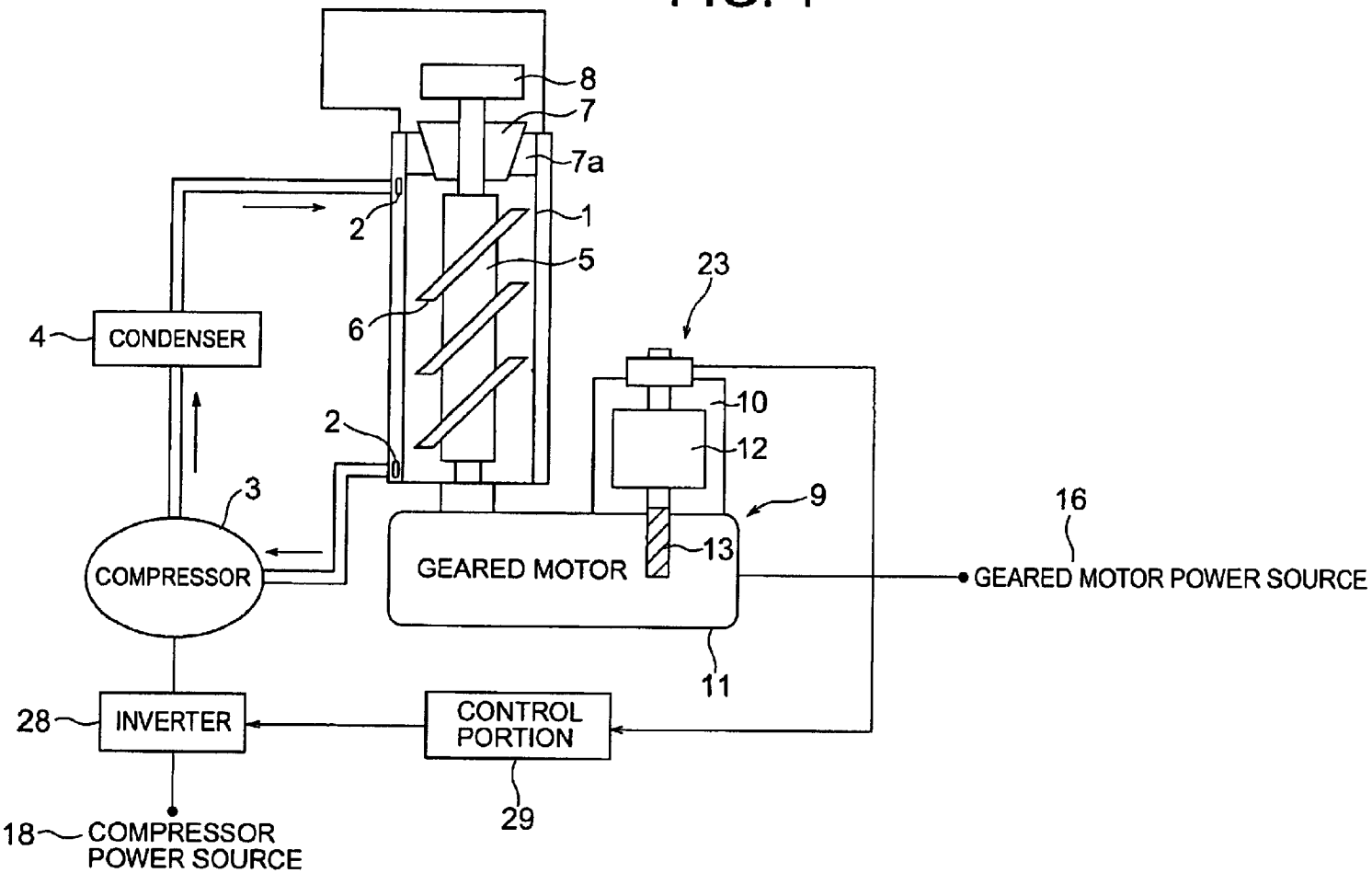
FIG. 4 is a diagram showing a construction of an auger type ice making machine according to Embodiment 2 of the present invention.

FIG. 4 shows the construction of an auger type ice making machine according to a second embodiment of the present invention. As far as the ice making mechanism portion and the refrigeration circuit are concerned, the auger type ice making machine of this embodiment is constructed in the same manner as in the above-described embodiment. The output shaft 13 in the motor portion 10 of the geared motor 9 is equipped with a rotary encoder 23 described below serving as the RPM detecting means. The geared motor 9 is connected to the geared motor power source 16. Further, the compressor 3 is connected to the compressor power source 18 through an inverter 28. The inverter 28 is controlled by a control portion 29 serving as a control means. The control portion 29 controls the inverter 28 based on a signal input from the rotary encoder 23.

Figure 5:
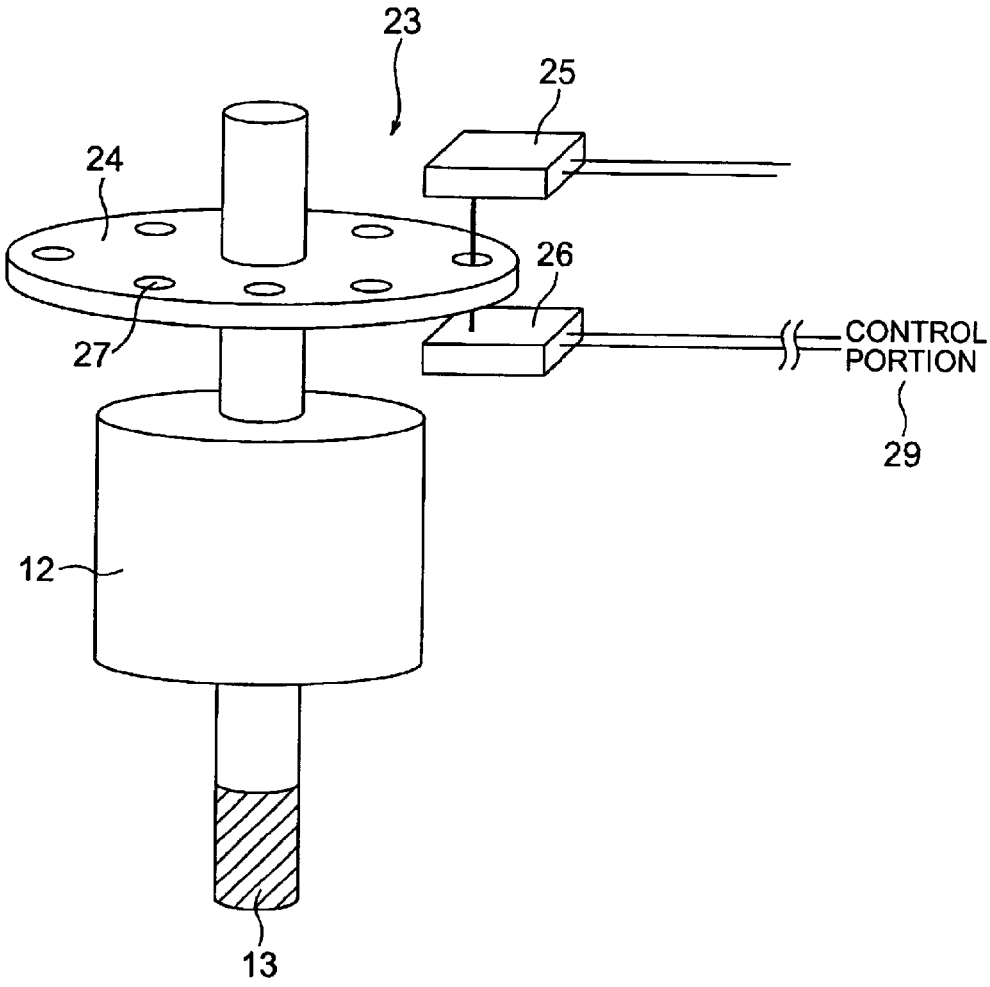
FIG. 5 is a diagram schematically showing a rotary encoder in the auger type ice making machine of Embodiment 2.

The rotary encoder 23 will be described with reference to FIG. 5. The rotary encoder 23 is equipped with a rotary disc 24, a light emitting element 25, and a light receiving element 26. The rotary disc 24 is provided on the output shaft 13 adapted to rotate integrally with the rotor 12, and rotates integrally with the output shaft 13. The rotary disc 24 is arranged so as to be sandwiched between the light emitting element 24 and the light receiving element 26, and is equipped with a plurality of slits 27. The light receiving element 26 is adapted to receive light from the light emitting element 25. When the rotary disc 24 rotates integrally with the output shaft 13, the light receiving element 26 receives exclusively the light passing through the slits 27. By thus counting the number of times that light has been received, the light receiving element 26 detects in detail the RPM of the output shaft 13, that is, the rotor 12. The RPM of the output shaft 13 thus obtained is transmitted to the control portion 29.

Next, the operation of the auger type ice making machine of the second embodiment will be described. In the geared motor 9, the rotation of the rotor 12 of the motor portion 10 is transmitted to the auger 5 through the output shaft 13 and the speed reduction portion 11 to thereby rotate the auger 5. The RPM of the rotor 12, that is, the RPM of the output shaft 13, is detected by the rotary encoder 23. The RPM detected as a signal is input to the control portion 29 from the rotary encoder 23. The control portion 29 controls the inverter 28 based on this signal. That is, when the RPM of the output shaft 13 detected by the rotary encoder 23 becomes smaller than the normal value, the control portion 29 controls the inverter 28 to adjust the compressor 3 to an appropriate RPM. That is, the inverter 28 adjusts the electric current supplied from the compressor power source 18, and reduces the RPM of the compressor 3. That is, by detecting the RPM by the rotary encoder, it is possible to control the refrigeration load at a stage in which the ice has slightly grown from normal. By controlling the RPM of the compressor 3, it is possible to mitigate the load on the geared motor and the upper bearing without having to stop the ice making machine.

Further, since the rotary encoder 23 is mounted directly to the output shaft 13, and the fluctuations in load are read directly, it is possible to achieve a high level of reliability. Further, the more the ice in the cylinder grows, the larger the load becomes, so that the load is detected at an early stage by the rotary encoder, thereby reducing the burden on the geared motor and the auger.

Embodiment 3

Next, an auger type ice making machine according to a third embodiment of the present invention will be described. Except for the cover structure for the RPM detecting means, this auger type ice making machine is of the same construction as that of the auger type ice making machine of the first embodiment shown in FIG. 1, that is, as far as the portions such as the ice making mechanism portion and the refrigeration circuit are concerned. The components that are the same as those of the first embodiment will be indicated by the same reference numerals as used in FIG. 1.

Figure 6:
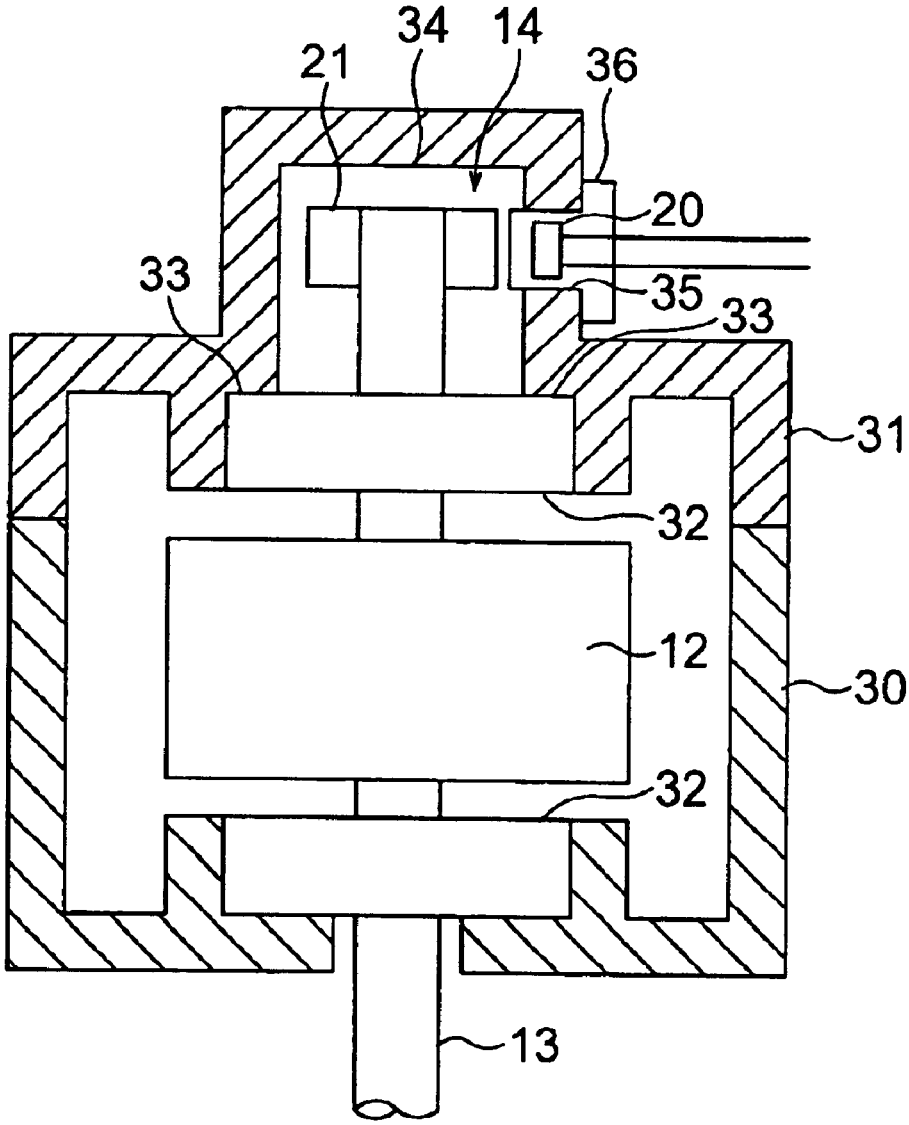
FIG. 6 is a sectional view of an auger type ice making machine according to Embodiment 3 of the present invention, showing a portion thereof in the vicinity of a rotor.

FIG. 6 shows the portion of the auger type ice making machine of a third embodiment in the vicinity of the rotor thereof.

Figure 7:
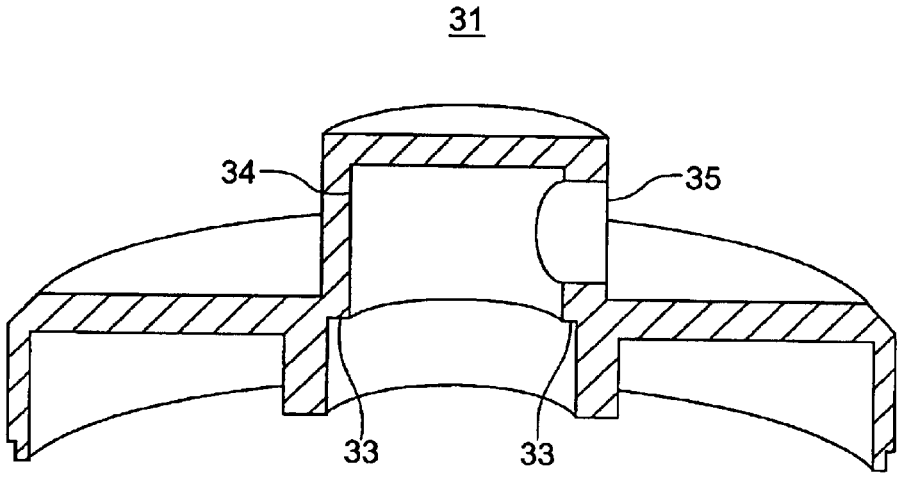
FIG. 7 is a perspective sectional view of a RPM detecting cover in the auger type ice making machine of Embodiment 3.

The periphery of the rotor 12 is covered with a rotor cover 30 and an RPM detecting means cover 31. The output shaft 13 of the rotor 12 is provided with bearings 32 that are above and below the rotor 12, and the rotor cover 30 and the RPM detecting means cover 31 respectively secure the associated bearings 32 in position. As shown in FIG. 7, the RPM detecting means cover 31 is equipped with a shoulder portion 33 for receiving upward load applied to the upper bearing 32, and, on the inner side of the shoulder portion 33, there is provided an upwardly extending cylindrical space 34. As shown in FIG. 6, in the space 34, there is arranged a rotary magnet 21 serving as an RPM output portion constituting an RPM detecting means. The rotary magnet 21 is provided at the upper end of the output shaft 13 inserted into the space 34. A hole 35 is provided in the side wall of the RPM detecting means cover 31 defining the space 34. A Hall IC 20 serving as an RPM detecting portion constituting the RPM detecting means is fitted into the hole 35 so as to be opposed to the rotary magnet 21. The Hall IC 20 is molded in a molding means 36 so as not to be splashed with water or oil. In this way, the bottom of the space 34 is covered with the bearing 32 provided below the rotary magnet 21, and is sealed up by closing the hole 35 in the side wall of the RPM detecting means cover 31 with the Hall IC 20 through the intermediation of the molding means 36. In order to prevent leakage of oil from the bearing, it is desirable to adopt a shielded bearing. However, since the Hall IC 20 is molded in, a little oil leakage does not greatly affect the performance of the pulse encoder 14.

The RPM detecting means cover 31 is a part that integrally molds the portion covering the upper portion of the rotor 12 while securing the upper bearing 32 and the portion covering the rotary magnet 21 of the pulse encoder 14. That is, the RPM detecting means cover 31 consists of a single component that covers the upper portion of the rotor 12 and the rotary magnet 21, that can be formed in a simpler structure than making the portion covering the upper portion of the rotor 12 and the portion covering the pulse encoder 14 separately and then assembling them with each other. That is, the RPM detecting means and the rotor are covered with a cover or the like to prevent intrusion of foreign matter such as dust. To prepare this cover as a separate component, several pieces of complicated sheet metal and resin molding are required to realize a dust-proof structure, resulting in high cost. However, in the RPM detecting means cover 31, the portion covering the upper portion of the rotor 12 and the portion covering the rotary magnet 21 are formed integrally with each other, which means a dust-proof structure is realized with a single component, and no surplus parts are required, thus minimizing production costs. Further, since the space 34 in which the rotary magnet 21 is provided is sealed, sufficient prevention of intrusion of foreign matter such as dust is possible.

Further, since the diameter of the space 34 is the same as the diameter of the inner peripheral edge of the shoulder portion 33, the RPM detecting means cover 31 as a whole including the portion covering the RPM output portion can be easily formed of a casting. In this embodiment, the hole 35 is formed after the casting.

The present invention is not restricted to the above-described embodiments but allows, for example, the following modifications.

While in the first embodiment a pulse encoder is used as the RPM detecting means of the present invention, it is also possible to use a rotary encoder. That is, it is also possible to perform relay control based on the RPM detected by the rotary encoder to control the compressor and the geared motor. Similarly, while in the second embodiment a rotary encoder is used as the RPM detecting means, it is also possible to use a pulse encoder. That is, it is possible to control the inverter based on the RPM detected by the pulse encoder to thereby control the compressor. Further, in the third embodiment, it is also possible to use a rotary encoder as the RPM detecting means. In that case, it is possible to use the rotary disc 21 as the RPM output portion, and the light emitting element 25 and the light receiving element 26 as the RPM detecting portion. Further, it is also possible to apply the RPM detecting means cover of the third embodiment to the auger type ice making machine of the second embodiment. Further, the RPM detecting means cover of the third embodiment is not restricted to the one in which the RPM detecting portion is supported by the side wall defining the space 34. It is also possible to arrange the RPM detecting portion in the space 34 and to cover both the RPM detecting portion and the RPM output portion.

As described above, in the auger type ice making machine of the present invention, the RPM of the geared motor is detected and controlled, whereby it has become possible to prevent an excessive load from being applied to the geared motor and the upper bearing of the auger.

Further, in the auger type ice making machine, the RPM of the geared motor is detected and the compressor is controlled, whereby it has become possible to prevent the interior of the cylinder from being excessively cooled and to prevent an excessive load from being applied to the geared motor and the upper bearing of the auger.

Further, in the auger type ice making machine, it is possible to accurately detect the RPM of the rotor, making it possible to cope with any change more quickly.

Further, in the auger type ice making machine, there is provided an RPM detecting means cover formed by integrally molding the portion covering at least a part of the rotor and the portion covering the RPM output portion, whereby it is possible to prevent foreign matter such as dust from entering the RPM output portion while avoiding an increase in cost.

What is claimed is:

1. An auger type ice making machine comprising:

a geared motor for driving an auger;

an RPM detecting means for detecting RPM of a rotor of the geared motor; and a control means for cutting the geared motor off based on the RPM detected by the RPM detecting means.

2. An auger type ice making machine according to claim 1, wherein the RPM detecting means is a pulse encoder or a rotary encoder.

3. An auger type ice making machine according to claim 1, characterized in that:

the RPM detecting means is equipped with an RPM output portion operationally connected with the rotor and an RPM detecting portion adapted to detect RPM from an operation of the RPM output portion; and the auger type ice making machine further comprises an RPM detecting means cover formed by integrally molding a portion covering at least a part of the rotor and a portion covering the RPM output portion.

4. An auger type ice making machine comprising:

a geared motor for driving an auger;

a compressor for compressing a refrigerant;

an RPM detecting means for detecting RPM of a rotor of the geared motor; and a control means for cutting the geared motor off and for controlling rotation of the compressor based on the RPM detected by the RPM detecting means.

5. An auger type ice making machine according to claim 4, wherein the RPM detecting means is a pulse encoder or a rotary encoder.

6. An auger type ice making machine according to claim 4, characterized in that:

the RPM detecting means is equipped with an RPM output portion operationally connected with the rotor and an RPM detecting portion adapted to detect RPM from an operation of the RPM output portion; and the auger type ice making machine further comprises an RPM detecting means cover formed by integrally molding a portion covering at least a part of the rotor and a portion covering the RPM output portion.

7. An auger type ice making machine according to claim 1, wherein the geared motor is connected to a geared motor power source through a relay, which is controlled by the control means based on a signal from the RPM detecting means.

8. An auger type ice making machine according to claim 4, wherein the geared motor is connected to a geared motor power source through a first relay, and the compressor is connected to a compressor power source through a second relay, wherein the first and second relays are controlled by the control means based on signals from the RPM detecting means.

* * * * *